United States Patent [19]

Weinar

[11] 4,281,494

[45] Aug. 4, 1981

[54] CONCEALABLE WALLBOARD FASTENERS AND WALLS ASSEMBLED THEREWITH

[76] Inventor: Roger N. Weinar, 168 Woodside Ave., Buffalo, N.Y. 14220

[21] Appl. No.: 947,077

[22] Filed: Sep. 29, 1978

[51] Int. Cl.[3] ..... E04B 1/38

[52] U.S. Cl. ..... 52/483; 52/346; 52/509

[58] Field of Search ..... 52/346, 489, 483, 509

[56] References Cited

U.S. PATENT DOCUMENTS

| | | | |
|---|---|---|---|
| 1,052,670 | 2/1913 | Francis | 52/714 |
| 2,041,773 | 5/1936 | Manske | 52/346 |
| 2,182,579 | 12/1939 | Bolton et al. | 52/346 X |
| 2,281,519 | 4/1942 | Faber | 52/489 |
| 3,187,389 | 6/1965 | Anderson | 52/489 |
| 3,391,508 | 7/1968 | Pestel et al. | 52/346 |
| 3,862,530 | 1/1975 | Martine | 52/489 |
| 3,863,412 | 2/1975 | Bodycomb | 52/346 X |
| 4,117,644 | 10/1978 | Weinar | 52/483 |

*Primary Examiner*—William F. Pate, III

*Attorney, Agent, or Firm*—Raymond F. Kramer

[57] ABSTRACT

A fastener for use with other such fasteners in concealably holding wallboard panels to framing members and in abutting linear relationship with each other is made of sheet metal and includes a first part suitable for fastening to and against a framing member, a second part overlying a part of said first part and farther from the framing member than the first part, when installed, an intermediate section connecting said first and second parts so they can move relatively, with the intermediate section resisting such movement, a web extending from said second part and at the web end, an impaling part for insertion into a wallboard.

21 Claims, 18 Drawing Figures

Fig. 6
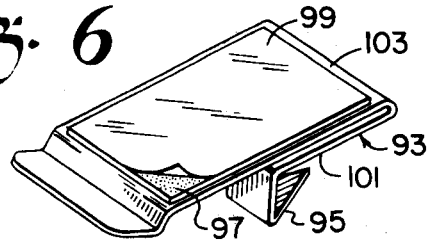
Fig. 7
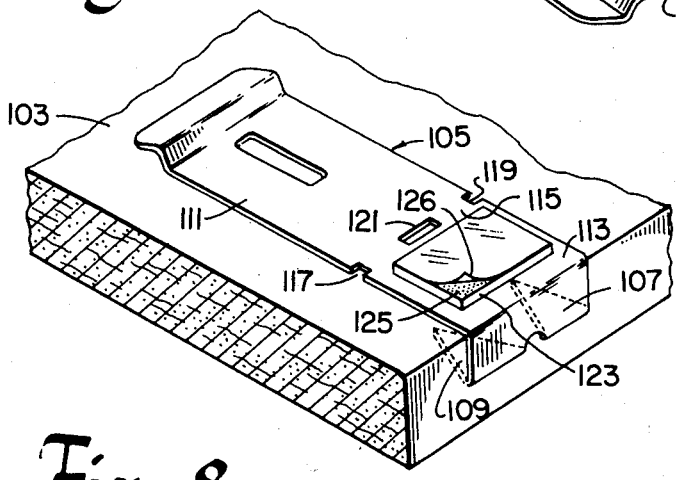
Fig. 8
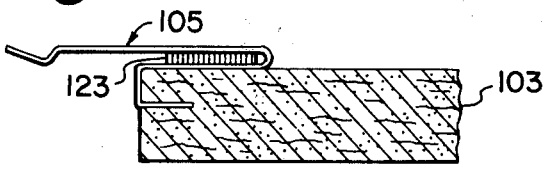
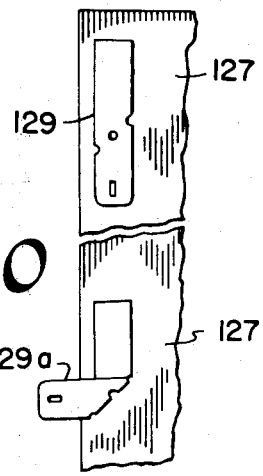
Fig. 10
Fig. 9
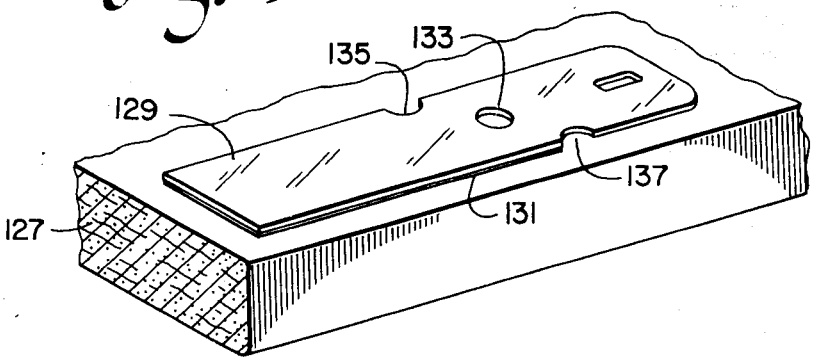

CONCEALABLE WALLBOARD FASTENERS AND WALLS ASSEMBLED THEREWITH

The present invention relates to concealable wallboard fasteners. More particularly, it relates to such fasteners which are suitable for easily mounting wallboard, such as pre-finished paper coated gypsum board, on framing members in desired abutting relationships with other such boards, in such manner that the mounted wallboards are capable of absorbing mechanical shocks without permanent displacement and additionally, are vibration-absorbing and acoustically improved.

Interior walls for residential, commercial, business and industrial buildings are conventionally made by mounting wallboard panels in abutting relationship on framing members, such as wood or metal studs and furring. The wallboards employed are presently produced of various compositions and structures but are usually comparatively thin rectangular panels. Most common of such panels are those of gypsum bases covered with a paper wrap. These wallboards or gypsum boards are often preferred for low cost, good fire resistance and ease of installation. Such wallboards or "dry-wall" panels are available in pre-finished form, with a decorative surface overwrap or coating or they may be finished after installation, as by the application of paint, wallpaper or other wall coating material. Unfinished walls constructed of the described unfinished wallboard may be taped or plastered at the abutting edges, which are often intentionally of lesser thickness than the main portion of the wallboard to allow for such tape thickness. Such taping or coating fills any nail holes or depressions made by applications of fasteners and also makes the wall desirably straight and smooth. Of course, pre-finished wallboards cannot be fastened to framing members by ordinary techniques because the fasteners would show or material for covering the fasteners (tape, plaster, etc.) would impair the appearance of the finish and thicken the board ends. Accordingly, concealed fasteners are highly desirable for the erection of walls from pre-finished wallboards and such fasteners can have application in assembly of walls from conventional wallboard panels.

Various concealed fastening devices for holding pre-finished panel boards and other wallboards to framing members and other supports have been described and several of these have been marketed. Among the more successful of such fasteners are those described in my U.S. patent 4,117,644, issued October 3, 1978, on application Ser. No. 736,425, filed October 28, 1976, which are now widely used in the construction industry. However, while such fasteners are economical, easy to employ and satisfactorily hold the assembled wall in position (and additionally possess another advantage, allowing the wall to be sequentially disassembled without destruction of the wallboards employed), it has been found in new building construction, especially when steel framing members, such as steel studs, are utilized, buiding vibrations can be transmitted to an objectionable extent to the panel members and sound deadening, especially important in office spaces wherein clerical machinery is being employed, may not be obtained to the extent which will be desired. Also, when assembled walls utilizing the clips of my previous patent application are subjected to mechanical shocks, by inadvertent contact with personnel or by moving of furniture or equipment against them all of such shocks is often not absorbed to a sufficient extent to avoid a permanent set and in some instances this leads to damage to the wall member and/or an irregular joinder line where two pre-finished wallboards abut.

Resiliently isolated panel construction has been employed previously, mostly in ceiling construction, wherein the ceiling framework may be suspended from resilient hangers. Also, elongated z-shaped sheet metal furring runners have been used, the web portions of which have been sufficiently weakened so as to allow resilient deflection of the outwardly facing flange and the affixed wallboards when mechanical forces are applied to the boards. Such structures for making resiliently mounted walls often require extensive special framing members and usual installation procedures and therefore have not been satisfactory. What has been needed is a means for conveniently and economically producing a resilient wall from standard wallboard panels, preferably of the pre-finished type, using concealed mounting means. Such is the subject of the present invention.

The closest prior art known to applicant has been described above. In addition thereto, it is considered that the references cited by the Examiner during the prosecution of U.S. patent 4,117,644 are also relevant. These include U.S. Pat. Nos. 1,052,670; 2,281,519; 2,325,766; 2,351,525; 2,568,490; 2,591,361; 2,851,740; 2,900,677; 2,924,963; 3,047,985; 3,187,389; 3,308,590; and 3,862,530; Canadian Pat. No. 543,324; and French Pat. No. 1,362,162. A British Gypsum catalog, brought to the attention of the Examiner by applicant, also may be relevant. Additionally, as is described in the amendment filed Oct. 27, 1977 in Ser. No. 736,425, it appears that wallboard mounting clips of the types described in that amendment as British Gypsum clips and Judkins clips may have been marketed, possibly only in foreign countries, prior to the filing date of Ser. No. 736,425. Applicant has been informed that the Judkins type clips are presently being marketed in the United States. These clips are said to be like those shown in U.S. Pat. No. 4,127,975.

The problem of making shock absorbing and satisfactorily acoustical walls from assembled wallboard, utilizing concealable clips or fasteners, has been solved by the present inventor by construction of a concealable fastener which performs the function of his fastener of U.S. Pat. No. 4,117,644 while at the same time creating a resilient mount for wallboards that allows them to be mounted in such manner as to absorb various types of mechanical shocks and still return to original position. Additionally, the wallboard construction resulting has a lesser tendency to transmit vibration and accordingly is acoustically acceptable. In accordance with the present invention a fastener for use with other such fasteners, to be held to abutting ends of wallboard panels for installation of such panels in abutting linear relationship with each other, with the major visible surfaces of such panels, when installed, being aligned, and for resiliently fastening such panels to framing members, comprises a first part, suitable for fastening to and against the framing member, a second part, substantially parallel to and overlying a part of said first part and farther from the framing member, when installed, than the first part, an intermediate section, connecting the first and second parts so that they can move relatively, a web extending from the second part and away from the first part and the framing member, an impaling part, extending from the web and in a direction toward the intermediate section, for insertion into an end of a wallboard panel, and spacing means at the first part of the fastener for spacing said first part away from a wallboard panel abutting that panel into which the impaling part is inserted, so as to align major visible surfaces of the adjoining wallboard panels so that they are coplanar. Also within the invention are various modifications of the basic fastener described, which may be of modified designs and include additional features, such as mounting slots, mounting adhesive means, leading edges for facilitating assembly and for spacing the wallboard from a framing member in which it is to be mounted, supplementary "spring" members, intermediate sections of modified structures, pre-installed fasteners held in place substantially flat against the wallboard and bendable into desired shape, and divisible fasteners, a portion of which, after such division, may be used to hold the wallboard at right angles to another such board. Additionally, the invention applies to the assembled walls made and to methods for their construction.

The invention, objects thereof and advantages resulting therefrom will be readily understood from the description herein, taken in conjunction with the drawing, in which:

FIG. 6 is a perspective view of another modification of the fastener having adhesive means applied thereto for holding the fastener to a framing member or wallboard;

FIG. 7 is a perspective view of a portion of a wallboard having pre-installed thereon a modified form of fastener of this invention which may be bent to final shape when the wallboard is ready for installation, illustrating a weakened portion of the fastener to facilitate such bending, together with cushion means to improve resilience of the fastener;

FIG. 8 is a bottom plan view (considering the wallboard as being in a normal vertical position) of the board and fastener of FIG. 7 after bending of the fastener to desired final configuration;

FIG. 9 is a perspective view of another preinstalled fastener on a wallboard;

FIG. 10 is a partial elevational view of the wallboard having a pair of fasteners like that of FIG. 9 thereon, with one such fastener having been bent to final form and the other not yet having been so bent;

Figure 15:
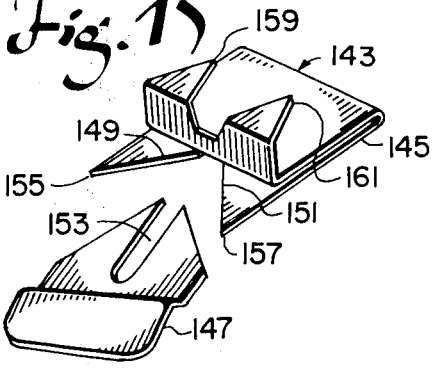
Figure 16:
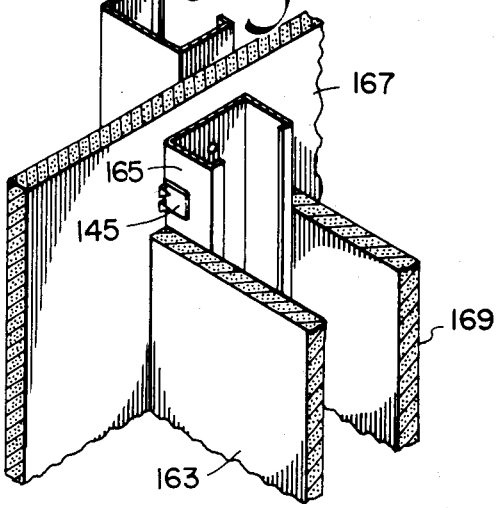

FIG. 15 is a perspective view of a modified fastener of this invention, initially having pre-marked lines or other indicia thereon, with a portion of said fastener having been removed along said lines so as to make the fastener useful for holding wallboards in abutting perpendicular relationship; and FIG. 16 is a partially cut away and sectioned view of wallboards being held in perpendicular abutting relationship by means of several concealable (and concealed) fasteners of FIG. 15.

Figure 17:
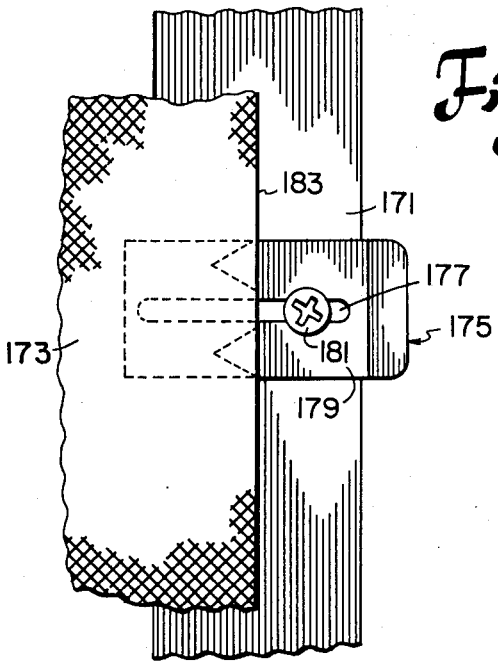
Figure 18:
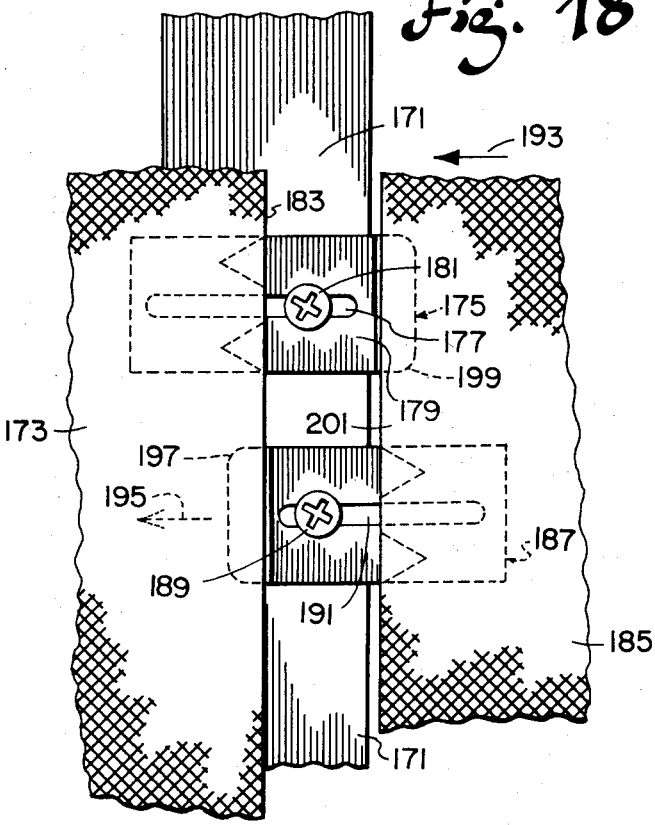

FIG. 17 is a partial elevational view of the installation of a wallboard, with fastener of this invention impaled thereon, on a steel stud with a self-drilling, self-tapping screw holding the board to the stud, prior to the installation of an abutting wallboard panel; and FIG. 18 is a view like that of FIG. 17, with the second wallboard being moved into position while being frictionally held to the stud by another screw and a held fastener.

Figure 1:
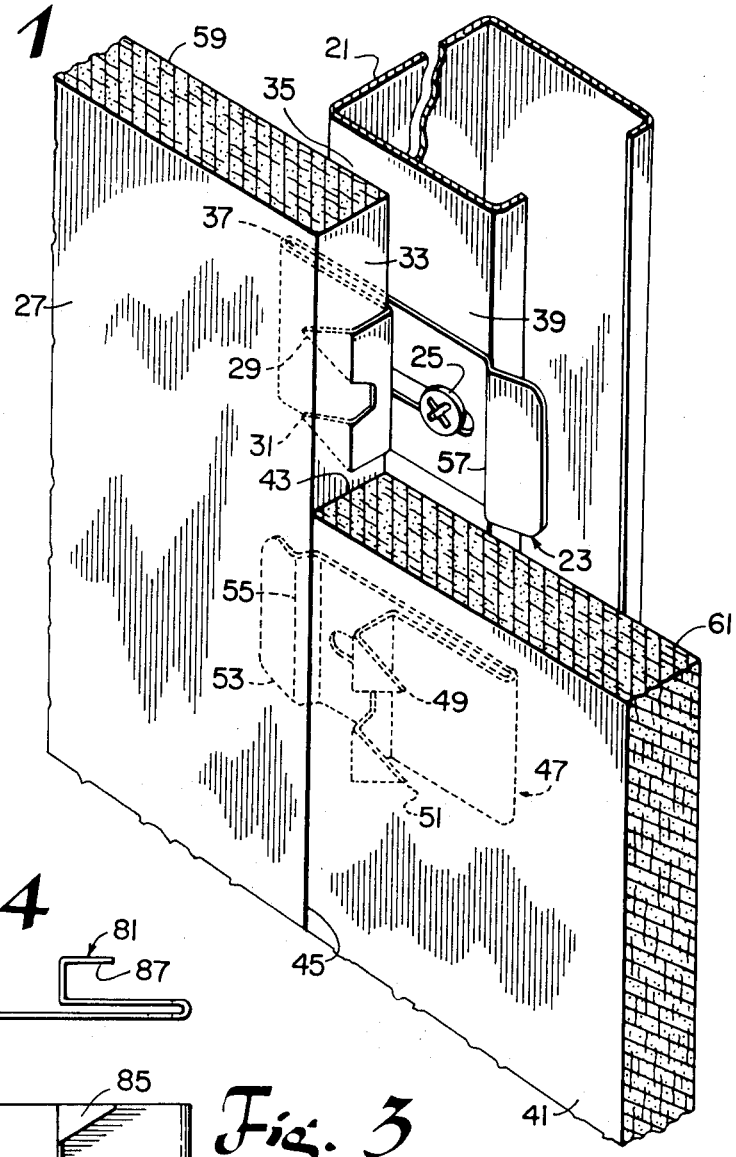
FIG. 1 is a partial view in perspective, partially cut away for purpose of illustration, of a pair of prefinished wallboard panels concealably mounted onto a framing member by fasteners of this invention.

In FIG. 1 there are shown steel stud 21 having wallboard fastener 23 held thereto by self-drilling, self-tapping screw 25. Fastener 23 holds wallboard panel 27 by impalement of the fastener impaling points 29 and 31 into the vertical end 33 of wallboard panel 27. As will be seen from the construction of the fastener 23, wallboard 27 is maintained by fastener 23 in position with respect to framing member or stud 21 so that there is a clearance 35 between the wallboard and the stud. Also, by virtue of the construction of the fastener, which will be described in more detail when reference is made to FIG. 2 herein, there is a clearance 37 between sections of the fastener, which allows for desirable limited movement of the fastener and held panel 27 in response to mechanical shocking forces which may be applied to the panel. Clearance 35 allows such movement without limiting it by contact of panel 27 and front wall (that facing the wallboard being applied, "front" being toward the viewer) portion 39 of stud 21. Fastened in place in abutting relationship with panel 27 is pre-finished wallboard panel 41, which fits tightly against such other panel along abutment plane 43 or visible abutment line 45, being held in place by wallboard fastener 47, which is identical with fastener 23 but which is not, as shown, fastened to stud 21. Fastener 47 has impaling points 49 and 51 thereof impaled into wallboard 41 at the vertical side or end thereof shown abutting end 33 of wallboard panel 27 before placement of panel 41 into position. Then, with lead-in portion 53 of fastener 47 being inserted into clearance 35 between panel 27 and framing member 21, with panel 41 being held at a small acute angle, e.g., 10° with respect to face 39 of stud 21, panel 41 is moved into position against panel 27, end to end, and usually simultaneously panel 41 is aligned with panel 27 in linear relationship, so that the major forward surfaces of such panels, facing the viewer, form a continuous plane. Panels 27 and 41 are held off from contact with stud 21 by resilient clip fasteners 23 and 47 and hump portions or bend surfaces 57 and 55 of fasteners 23 and 47, respectively, bear against the back major surfaces 59 and 61 of the first and second installed panels, respectively. In addition to fasteners 23 and 47 there will be affixed to each of the described wallboards similarly positioned fasteners in alternating arrangement. Normally, when four foot by eight foot (1.22 by 2.44 meters) wallboards are installed from 4 to 20 clips will be utilized, 2 to 10 on each board on each side of the abutting sides. Preferably 6 to 12 clips are present per panel. The method of assembly described is like that shown in my previous patent 4,117,644, referred to above.

The assembly of this invention, as illustrated in FIG. 1, possesses a resilience not found to such an extent in the assemblies of my patent 4,117,644. Because of this and the holding of the wallboard panels off the framing member surface and in contact with it only through a resilient portion of the fastener, less vibration and noise transmission results with the present installations. Additional benefits in this respect are obtainable by coating the back surface of the first part of the fasteners with sound insulating or vibration dampening materials, such as an elastomer, e.g., rubber or polyurethane, of sufficient elasticity as to absorb vibration. Foam rubbers and plastics of acceptable properties may also be used. Similarly it may be desirable to coat other wall and framing contacting portions of the present clips, such as those indicated at 55 and 57, with elastomer or other suitable material for reducing vibration and sound conduction. In some cases the presence of such coatings, such as on contact edges 55 and 57, will assist in minimizing a possibly undesirable sliding of the panels past the fasteners, at least initially (because later the assembly of panels prevents such movement).

Figure 2:
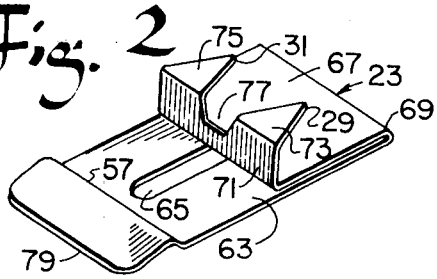
FIG. 2 is a perspective view of a fastener of this invention, of the type also illustrated in FIG. 1.

In FIG. 2 are shown more details of a clip of FIG. 1. Clip 23 includes a first part 63, which is substantially flat and has a central longitudinal axial slot or opening 65 therein through which it may be screw fastened to a framing member. A second substantially flat part 67 of the fastener overlies the first part and, when installed on a framing member, it is farther away from it. Intermediate section 69 connects the first and second parts, allowing relative movement thereof, like a motion resisting hinge. Web 71 extends from the second part and from it extends an impaling part, shown in FIG. 2 as impaling portions 73 and 75, which terminate in points 29 and 31, respectively. As will be noted, impaling portions 73 and 75 are separate, with an opening 77 between them, which extends into web 71. The presence of such opening facilitates manufacture of the present fasteners and additionally, helps obtaining of a better grip on the impaled covered wallboard panel.

The fastener of FIG. 2 (as well as other fasteners illustrated herein) is made of a single sheet of material, preferably hardened spring steel, such as SAE 1050 high carbon spring steel (1030–1060 may also be employed) which is annealed before forming and after forming is heat treated (hardened) to a Rockwell hardness in the range of C-24–34, preferably C-28 or C-30. However, it is within this invention to utilize other suitable materials, such as sheet steel, other metals, including aluminum and magnesium-aluminum alloys, synthetic organic polymeric plastics, such as nylons, acrylates, fiberglass-reinforced polyesters and engineering plastics. Such materials may be molded or otherwise shaped to form but preferably, when a metal is being utilized, an essentially flat piece of material, cut to desired pattern, will be bent so that the first and second parts are parallel or essentially parallel to each other and the web will extend at right angles to said first and second parts and be located at an end of the second part away from the intermediate section. The impaling points will be in planes substantially parallel to the first and second parts and the points thereof will point in the direction of the intermediate section. In the fastener illustrated in FIG. 2 a lead-in portion 79 is bent away from the framing member, referring to the installed position of the fastener, and then back toward said member at an angle so as to facilitate installation of a wallboard panel, to which it is fastened by impalement, in abutting relationship with another such panel held to a framing member by such a fastener. It will be noted in the accompanying illustration (and this is more clearly shown in FIG. 4) that the lead-in portion extends away from the framing member, when installed, a distance equal to that between the framing member surface and a surface of the second part of the fastener which is normally in contact with a wallboard panel when installed thereon. This helps to regulate the correct holdings of the abutting wallboard panels so that their front surfaces are aligned. Preferably, the lead-in portion will have rounded corners and the end thereof will be at an angle between 20° and 40°, e.g., 30°, with respect to an extension of the plane of the first part of the fastener. Preferably too, the lead-in portion will terminate at a plane which is an extension of the surface of the first part of the fastener, which is normally in contact with the framing member, when installed.

Figure 4:
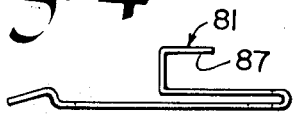
FIG. 4 is a bottom plan view of the fastener of FIG. 3.
Figure 3:
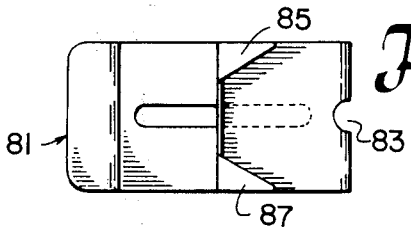
FIG. 3 is an elevational view (considering normal installed position) of the fastener of FIGS. 1 and 2, modified by removal of material therefrom to promote ease of resilient bending between major surfaces thereof and by modification of the shape of the impaling points.

FIGS. 3 and 4 illustrate the shape in profile of the fasteners of FIGS. 1 and 2 but also show modifications thereof. Thus, fastener 81 has a section 83 cut out of the intermediate or spring hinge portion thereof to promote greater flexibility of the clip. Such opening may be modified in shape and length, as desired, depending on the material employed for the fastener and the extent of flexibility and resilience preferred. It will also be noted that ech of impaling portions 85 and 87, while pointed, has a side of each point parallel to an overlying side of the fastener. Such a structure requires less manufacturing effort and is considered to be essentially as effective as the symmetrically pointed embodiments previously described.

Figure 5:
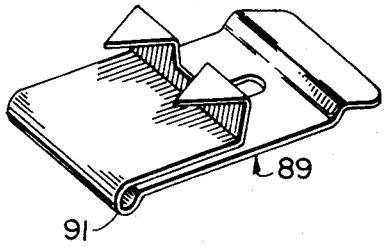
FIG. 5 is a perspective view of another modification of the fastener of FIGS. 1 and 2, wherein the portion between the major surfaces thereof is modified to improve resilient bending characteristics thereof.

In FIG. 5 fastener 89, while resembling the fastener of FIGS. 1 and 2 in most respects, includes a modified intermediate portion 91, which is seen to be circular curve (¾ of a circle long) and which is found to be more resilient than the ordinary bends illustrated in FIGS. 1–4 (which are also curved somewhat, but more severely). The curve of the circular intermediate portion of FIG. 5 is of a diameter about twice the distance between outer surfaces of the first and second fastener parts but such curve may be from 1.5 to 5 times such diameter, too, with good springy effect. Of course, other modified forms of intermediate sections may be employed for best results under particular circumstances.

In FIG. 6 fastener 93 of this invention is shown to be like that of FIGS. 1 and 2 except for the substitution of adhesive means for holding the fastener to a framing member (in place of the slot-screw combination of FIGS. 1 and 2) and also, impaling portion 95 thereof is not parallel to the first and second parts but is inclined slightly toward the second part so as to improve holding capability when installed on particular wallboard panels. The angle at which impaling portion 95 is inclined toward second part 101 will usually be within the range of 5° to 25° (0° being parallel). The fastener of FIG. 6 has a continuous first part, unslotted and unperforated, covered with an adhesive material over substantially the entire face thereof intended for contacting a framing member. Such adhesive may be a pressure sensitive silicone or butyl rubber, often with a suitable solvent also present. Adhesive 97 is protected by cover 99, which is removed before installation of the fastener. Instead of utilizing a pressure sensitive cement, chemically reactive materials which form thermosetting adhesive polymers may be employed, as may be other types of adhesives and cements. It is within this invention to utilize encapsulated cements, the capsules of which are ruptured on installation, in some of which cases previously separated reactive chemicals will be brought into curing contact by such rupturing. The adhesive, while it preferably covers all or substantially all of the surface of the first part 103, may cover a lesser portion and may be distributed in various patterns but normally covers at least 10% of the contacting surface of first fastener part 103.

FIGS. 7 and 8 illustrate two major modifications of the basic fasteners previously illustrated. First, as will be readily seen, to facilitate shipment of fasteners already installed on wallboard panels they are maintained in substantially flat position against the panel until the time of installation, when they may be bent to desired shape by the installer. Secondly, there is present in this aspect of the invention supplementary resilient means designed to promote the springing apart of the first and second fastener parts after application of a shock to the installed wallboard. In FIG. 7 wallboard panel 103 is shown prior to installation with fastener 105 impaled onto it by impaling portions 107 and 109. The first part 111 of fastener 105 and the second part 113 thereof are separated by intermediate part 115 which includes notches 117 and 119 and central cut-out 121. The material of the fastener may be soft or cold rolled steel because due to the presence of elastomeric (rubber) pad 123, when, at the time of installation, the first part of the fastener is bent at the intermediate section to parallel the second part thereof, elastomeric pad 123 prevents it from coming into contact with such second part and returns it to desired position after installation when the wallboard panel may be subjected to otherwise damaging shocks. Notches 117 and 119 and opening 121 make the intermediate section pre-weakened or controllably bendable but in some instances such will not be employed and bending will be effected on site by conventional means, e.g., vise, pliers. As illustrated, elastomeric pad 123 is held onto second part 113 of fastener 105 by an adhesive, not shown, and an adhesive covering 125 is present to hold it to the first part of the fastener when the fastener is in final bent position. Adhesive covering 125 may be dispensed with in many instances and elastic pad 123 may be held to the fastener by other means than adhesives. Adhesive 125 may be protected by cover 126. Also, the shape of the pad may be altered and a plurality of smaller resilient parts may be utilized instead. In FIG. 8 the fastener 105 of FIG. 7 is shown in final bent and installed position on wallboard panel 103.

FIGS. 9 and 10 illustrate a modification of the embodiment of the invention shown in FIGS. 7 and 8 but without any intermediate resilient or spring member and with the bend line being at an acute angle (45°) rather than perpendicular to the fastener axis, as shown in FIGS. 7 and 8. In FIG. 9 wallboard panel 127 has flat fastener 129 held to it by adhesive layer 131. Fastener 129 includes circular opening 133 and side openings 135 and 137, set at an angle to the axis of the fastener so that on bending along a line connecting the center points of said hole and openings, a right angle bend will be obtained, as shown in FIG. 10. In FIG. 10, in the upper portion thereof is illustrated fastener 129 on wallboard 127 whereas in the lower portion such fastener has been bent to desired final installed shape, designated **129*a*. When desired, bends may be made at other angles than 45° in particular installations. It is considered that the structure of FIGS. 9 and 10** possess an advantage because the elongated portion thereof adhesively secured to the wallboard is more vertical and thereby is of greater holding strength than if it were horizontal. Also, the employment of impaling portions, at least for one side of each wallboard, is obviated and a simpler bendable structure is utilized. However, there is the disadvantage that such fasteners will normally be factory installed and are not as readily produced on site by the installer, utilizing only ordinary wallboard and separate clips.

Figure 11:
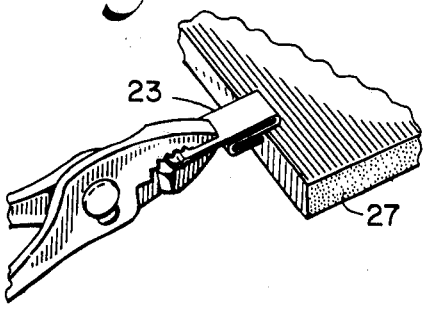
FIG. 11 is a perspective view showing application of the fastener of this invention to a wallboard.
Figure 12:
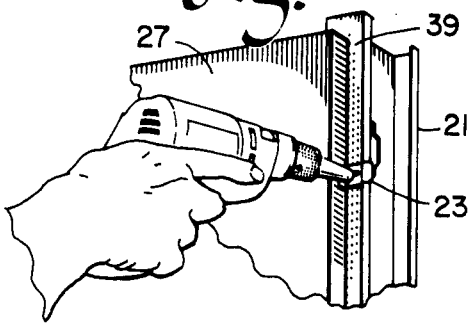
FIG. 12 is a perspective view illustrating fastening of a fastener and a wallboard into which the fastener has been impaled, onto a metal stud framing member by means of a drive screw.
Figure 13:
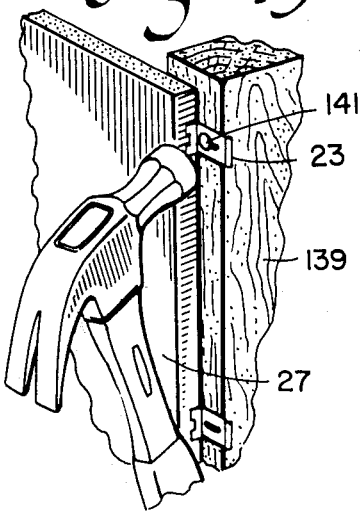
FIG. 13 is a view like that of FIG. 12 wherein such fastening is effected by nailing into a wooden stud member.

FIGS. 11–14 show steps in the installation of fasteners of this invention. In FIG. 11 a fastener of FIG. 2 is shown being installed on a wallboard by gripping the fastener longitudinally with a pair of pliers and pressing it, impaling points forward, into the board while holding a first surface thereof in contact with the board. Alternatively the clip may be tapped into place with a hammer by striking the web portions alternately. In FIG. 12, after installation of the fastener on the wallboard the combination fastener-wallboard is screwed onto a framing stud surface 39, utilizing a power tool and a self-drilling, self-tapping screw passing through a slot in the fastener and making its own hole and thread in the steel wall of the stud. (The slot permits ready adjustability of positioning). In FIG. 13 an alternative method of assembly, utilized when the stud is wood, is shown, with fastener 23, impaled on wallboard panel 27, being fastened onto wooden stud 139 by nail 141.

Figure 14:
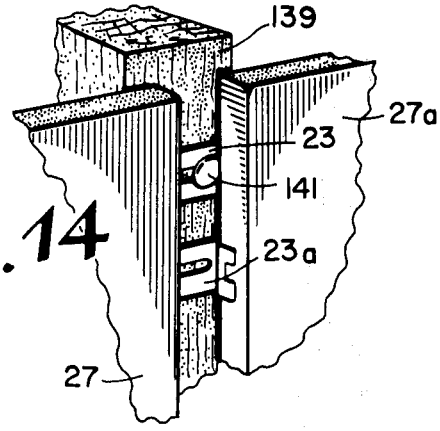
FIG. 14 is a perspective partial view of an intermediate stage in the assembly of the right wallboard into position against the left wallboard (the left wallboard having been installed as shown in FIG. 13)

In FIG. 14, with wallboard 27 being held to stud 139 by fastener 23 and nail 141, wallboard **27*a*, with fastener 23*a* impaled thereon, is shown being slid into place with fastener 23*a* passing behind the back side of panels 27. Of course, panel 27*a* will be moved to the left sufficiently so that it abuts panel 27 and subsequently another panel will be installed to the right of it, holding it in position, with fastener 23*a* preventing forward movement of panel 27*a***.

In FIG. 15 is shown fastener 143 in separated position, with waste portion 147 having been removed from fastener section 145, which is designed for installation of perpendicular wallboards, as is illustrated in FIG. 16. Initially, the two parts shown in FIG. 15 were one, with a marked or scored pair of lines 149 and 151 extending from sides of the fastener to walls therein of slot 153. Prior to use, the fastener is cut or sawn along such lines, resulting in the creation of impaling points 155 and 157, in addition to conventional impaling portions 159 and 161. As is seen in FIG. 16, fastener 145, after disposal of the waste portion of original fastener 143, is impaled on wallboard 163, with points 159 and 161 penetrating the wallboard and with the fastener between such wallboard and framing stud 165. Points 155 and 157 of the fastener are not shown but obviously are transversely penetrating wallboard 167, which is positioned at right angles to panel 163. Thus, fastener 145 facilitates holding of panels 163 and 167 in desired perpendicular relationship. Panel 169 may be similarly held. Of course, instead of cutting or sawing fastener 143, it may be utilized as in FIG. 1, making it suitable for various construction assembly tasks.

FIGS. 17 and 18 are illustrative of an advantageous type of assembly of wallboards using the present fasteners wherein, instead of only alternating fasteners being attached to the framing member, all such fasteners are so attached, for greater strength of the assembly. Still, with the resilient fasteners of this invention acoustical and vibrational problems are ameliorated. In FIG. 17, steel stud member 171 has fastened to it a pre-assembly of a embossed vinyl covered paper wrapped gypsum core wallboard panel 173 and fastener 175. Fastener 175 includes a longitudinal, axial slot 177 in the firstpart 179 thereof and through such slot screw 181 holds the fastener and the wallboard panel on which it is impaled to stud 171. It is noted that in the illustration given the end or edge 183 of wallboard panel 173 is at about the vertical center line of stud 171. In FIG. 18 there is shown the subsequent installation of a pre-assembly of a similarly embossed and covered wallboard panel 185 and an impaling fastener 187 held onto stud 171 by means of screw 189, which passes through slot 191 and holds the fastener to the stud. Arrows 193 and 195 show the direction of intended movement of panel 185 and attached fastener 187 after tightening of screw 189 to such an extent that it holds fastener 187 to stud 171 but also allows some frictionally resisted movement of the fastener and impaled panel. Thus, because of the presence of lead-in edges 197 and 199 panel 185 can be slid into position with leading edge 201 thereof being brought into contact with edge 183 of panel 173 and with fasteners 175 and 187 and screws 181 and 189 being concealed behind the wallboard panel. Of course, slot 191 will be sufficiently long so that fastener 187 may be moved horizontally to the left with respect to screw 189 until panel 185 abuts panel 173. Usually, the slots in such fasteners will be from 70 to 90% of the length of the first portions thereof, up to the lead-in sections. Normally the slots will be just wide enough to accommodate the screws to be employed and will be axially positioned but they may be located above and below the central horizontal axis, too. When the clips are installed, as illustrated in FIGS. 17 and 18, and usually also for the other illustrations shown, the lead-in portions will be past the ends of the studs, with the ridge portions thereof somewhat past said ends, for best support by the studs of such ridge portions, so that the desired spacing between the studs and back sides of the panel will be desirably resiliently maintained.

The invention has been described in detail with respect to various preferred embodiments thereof but it is evident that its scope is not to be so limited because one of skill in the art with the present specification before him will be able to utilize substitutes and equivalents for elements thereof without departing from the invention. Similarly, while various variations of the invention have been mentioned they are not exhaustive and neither are the advantages thereof, as previously mentioned.

For example, instead of coating with elastomer or other useful vibration damping material only a portion of the present clips, they may be completely covered therewith. Instead of using rubber coating of the clips or portions thereof one may substitute non-integral pads of vibration damping material and place these between the clips and the adjacent framing members and wallboard panels. Where adhesives are employed they may be applied to both clips and panels, not merely to one or the other. Thermal insulation may be applied to the clips, studs and panels. Walls made may be of different shapes than rectangular and may be slanted up or down. They also may be curved and/or directed inwardly and outwardly. Instead of full floor to ceiling walls the present invention may be used for the assembly of partitions. Also, the advantages of the invention are numerous, in addition to shock absorption, resilience and sound and vibration damping. Because of the limited contact between walls and studs and between first and second clip sections (contact being limited to the material of the intermediate section) the present clips allow the constructions of walls of improved fire resistance ratings and it is found that the present construction transmits heat from the room through it to the area behind the studs at a rate appreciably slower than normal wall constructions. While the shock absorbing property is most important for preventing damage to the panels from comparatively light shocks it also helps to reduce the effects of more severe shocks, both during assembly of the walls and afterward. The slight yieldings of the clips when the panel is stuck actually help to absorb the shock and reduce damage to the board. And this is accomplished without permanent alteration of the board appearance and position. Additionally, the assembly of walls with the present clips is faster and cheaper than by so-called "standard" methods.

What is claimed is:

1. A fastener for use with other such fasteners, to be held to abutting ends of wallboard panels for installation of such panels in abutting linear relationship with each other, with the major visible surfaces of such panels, when installed, being aligned, and for resiliently fastening such panels to framing members, which comprises a first part, suitable for fastening to and against the framing member, a second part, substantially parallel to and overlying a part of said first part and farther from the framing member, when installed, than the first part, an intermediate section, connecting the first and second parts so that they can move relatively, a web extending from the second part and away from the first part and the framing member, an impaling part, extending from the web and in a direction toward the intermediate section, for insertion into an end of a wallboard panel, and spacing means at the first part of the fastener for spacing said first part away from a wallboard panel abutting that panel into which the impaling part is inserted, so as to align major visible surfaces of the adjoining wallboard panels so that they are coplanar.

2. A fastener according to claim 1 which is made from a single piece of sheet material and wherein the first and second parts are substantially flat and parallel to each other, the intermediate section is that resulting from bending a substantially flat piece of material at least partially back on itself to form the first and second parts and the intermediate section therebetween, the web extends substantially at right angles to said first and second parts from the end of said second part away from the intermediate section, the impaling part extends from the end of the web and includes at least two pointed members substantially parallel to the first and second parts with the points thereof pointing in the direction of the intermediate section, and the spacing means is a bend or hump on a surface of or near an end of the first part and extends away from the framing member, when the fastener is installed in a wall assembly.

3. A fastener according to claim 1 wherein the intermediate portion is in the form, in cross-section, of about ¾ of a circle, to provide improved springiness and thereby to improve the shock resisting capability of a wallboard assembly installed by means of the present fasteners and to improve the acoustical properties thereof.

4. A fastener according to claim 1 wherein the first part, on a surface thereof intended to contact a framing member when installed, is at least partially coated with adhesive which is coated with a readily removable protective film for maintaining the adhesive nature of the adhesive before use.

5. A fastener according to claim 1 wherein the intermediate section has material removed therefrom to promote ease of bending thereof so as to facilitiate relative movements of the first and second parts in responses to shocks.

6. A fastener according to claim 1 which is of spring steel so that the intermediate section thereof is resilient enough to return to original position after distortion of the fastener by mechanical shock or pressure which moves the first and second parts thereof together.

7. A fastener according to claim 1 wherein at least a portion of the surface of the first part thereof which is held against the framing member and a wallboard panel having the fastener attached thereto, when installed, is covered with a non-metallic, resilient, energy absorbing, vibration absorbing acoustical material.

8. A fastener according to claim 7 wherein the entire such surface is covered with such energy absorbing material and such material is an elastomer.

9. A fastener for use with other such fasteners, to be held to abutting ends of wallboard panels for installation of such panels in abutting linear relationship with each other and for fastening them to framing members, which is made from a single piece of sheet material and which comprises an essentially flat first part, suitable for fastening to and against the framing member, and an essentially flat second part, parallel to and overlying a part of said first part and farther from the framing member, when installed, than the first part, an intermediate section, connecting the first and second parts so that they can move relatively, which section is that resulting from bending an essentially flat piece of material at least partially back on itself to form the first and second parts and the intermediate section therebetween, a web extending from the second part substantially at right angles to said first and second parts from the end of said second part away from the intermediate section and extending away from the framing member, an impaling part for insertion into an end of a wallboard panel, which part extends from the end of the web in a direction toward the intermediate section and includes at least two pointed members substantially parallel to the first and second parts with the points thereof pointing in the direction of the intermediate section, and wherein the first part, at an end thereof opposite that adjacent the intermediate section, is bent away from the framing member, referring to the installed portion of the fastener, and then back toward said framing member at an angle to the rest of the first part so as to provide a lead-in portion for installation of a wallboard to which it is fastened, by impalement, in abutting relationship with another such wallboard held to a framing member by such a fastener.

10. A fastener according to claim 9 wherein the first part includes a longitudinal slot for screw, nail or other mounting of the fastener onto the framing member, the impaling part consists of two pointed members set apart from each other and near sides of the web, the web has a portion thereof between the pointed members removed to improve impalement and the lead-in portion extends away from the framing member, when installed on a surface thereof, a distance equal to that between the framing member surface and a surface of the second part of the fastener which is normally in contact with a wallboard panel when installed thereon.

11. A fastener according to claim 10, made of sheet spring steel.

12. A fastener for use with other such fasteners, to be held to abutting ends of wallboard panels for installation of such panels in abutting linear relationship with each other and for fastening them to framing members, which comprises a first part, suitable for fastening to and against the framing member, a second part, substantially parallel to and overlying a part of said first part and farther from the framing member, when installed, than the first part, an intermediate section connecting the first and second parts so that they can move relatively, a web extending from the second part away from the first part and away from the framing member and, extending from the web and in a direction toward the intermediate section, an impaling part for insertion into an end of a wallboard panel, wherein the first part, at an end away from the intermediate section, terminates in a lead-in portion which includes a section bent away from the framing member, referring to the installed position of the fastener, and then back toward said framing member at an angle to the rest of the first part, to facilitate installation of a wallboard to which it is fastened, by impalement, in abutting relationship with another such wallboard held to a framing member by such a fastener.

13. A fastener for use with other such fasteners, to be held to abutting ends of wallboard panels for installation of such panels in abutting linear relationship with each other, with the major visible surfaces of such panels, when installed, being aligned, and for resiliently fastening such panels to framing members, which comprises a first part, suitable for fastening to and against the framing member, a second part, substantially parallel to and overlying a part of said first part and farther from the framing member, when installed, than the first part, an intermediate section, connecting the first and second parts so that they can move relatively, a web extending from the second part and away from the first part and the framing member, an impaling part, extending from the web and in a direction toward the intermediate section for insertion into an end of a wallboard panel, and a cushioning member between opposed surfaces of the first and second parts to aid in absorbing mechanical shocks applied to the fastener when installed on a wall panel and to assist in returning it to original position after cessation of applications of said shocks.

14. A fastener according to claim 13 wherein the cushioning means is a resilient elastomeric pad fastened to at least one of the first and second parts of said fastener.

15. A fastener for use with other such fasteners in concealably holding wallboard panels to framing members and in abutting linear relationship with each other which comprises a first part, suitable for fastening to and against a framing member, a second part overlying a part of said first part and farther from the framing member, when installed, than the first part, an intermediate section, connecting the first and second parts so that they can move relatively, a web extending from said second part and, extending from the web, an impaling part for insertion into a wallboard, which fastener has an angular marking on the first part thereof so that a part of it may be separated from another part of the fastener along said marking, producing an impaling part with an impaling point directed oppositely to the impaling part extending from the web, to facilitate holding of wallboard panels in abutting perpendicular relationship, with the impaling part extending from the web impaling a first wallboard longitudinally and the other impaling part impaling an abutting perpendicular wallboard transversely.

16. A fastener according to claim 15, having a longitudinal axial slot in the first part thereof, wherein the marking is a pair of score lines, the first impaling part consists of a pair of impaling points and the second impaling part, after removal of a portion of the first part of the fastener along the score lines, which removal is effectable by cutting or sawing along said score lines, consists of two points, each extending from a side of said first part of the fastener toward the slot in said first part, which slot facilitates the cutting or sawing along the score lines to form separated impaling points.

17. A fastener for use with other such fasteners in concealably holding wallboard panels to framing members and in abutting linear relationship with each other which comprises an essentially flat first part, suitable for fastening to and against the framing member, an essentially flat second part substantially parallel to the first part, overlying a part of said first part and farther from the framing member, when installed, than the first part, an intermediate section connecting the first and second parts so that they can move relatively, a web extending substantially at right angles to said first and second parts from the end of said second part away from the intermediate section and an impaling part for insertion into a wallboard, which impaling part extends from the end of the web and includes at least two pointed members substantially parallel to the first and second parts, with the points thereof pointing generally in the direction of the intermediate section, the two pointed members being set apart from each other and near sides of the web, the fastener being made from a single piece of sheet material bent back on itself to form the first and second part and the intermediate section therebetween, with a portion of the web between the pointed members having been removed to improve impalement and with the first part, at an end thereof opposite to that adjacent the intermediate section, being bent away from the framing member, referring to the installed position of the fastener, and then back toward said framing member at an angle to the rest of said first part, so that the end thereof is at an angle between 20° and 40° with respect to an extension of the plane of the first part of the fastener, to form a lead-in portion which terminates at a plane which is an extension of the surface of the first part of the fastener, which lead-in portion extends away from the framing member, when installed on a surface thereof, a distance equal to that between the framing member surface and a surface of the second part of the fastener which is normally in contact with a wallboard panel when installed thereon, and which lead-in portion includes rounded corners.

18. A fastener for use with other such fasteners in concealably holding wallboard panels to framing members and in abutting linear relationship with each other which comprises a first part, suitable for fastening to and against the framing member, a second part overlying a part of said first part and farther from the framing member, when installed, than the first part, an intermediate section connecting the first and second parts so that they can move relatively, a web extending from said second part and, extending from the web, an impaling part for insertion into a wallboard, with the first part, at an end thereof opposite to that adjacent the intermediate section, being bent away from the framing member, referring to the installed position of the fastener, and then back toward said framing member at an angle between 20° and 40° with respect to an extension of the plane of the first part of the fastener, and terminating at a plane which is an extension of the surface of the first part thereof.

19. A wall or partition comprised of a plurality of wallboard panels in abutting and aligned relationship with each other, with fasteners concealedly holding the panels together at abutting edges thereof and holding them to a framing member, which fasteners each have a first part suitable for fastening to and against the framing member, a second part overlying a part of said first part and farther from the framing member, when installed, than the first part, an intermediate section connecting the first and second parts so that they can move relatively in a plane having a component at right angles to the plane of the installed panels, a web extending from said second part, an impaling part extending from the web and in a direction toward the intermediate section for insertion into the wallboard, and spacing means at the first part of each fastener for spacing said first part away from a wallboard panel abutting that panel into which the impaling part is inserted, so as to align major visible surfaces of the adjoining wallboard panels so that they are coplanar.

20. A wall according to claim 19 wherein each of the fasteners includes a slot extending a substantial part of the length of the fastener, through which the fastener may be fastened to the framing member, and wherein a plurality of fasteners is alternately fastened to abutting panels in alternating directions, with screws or nails or other similar fasteners holding them, through the slots therein, to the framing members, so as to increase permanence of resilient holding of the panels to the framing member.

21. A wall according to claim 20 wherein half of the fasteners are screwed to a metal stud through the slot in frictionally slidable engagement therewith and the other half, impaled onto an abutting wallboard, are tightly screwed to the stud.

* * * * *